United States Patent [19]

Hough

[11] 4,065,826

[45] Jan. 3, 1978

[54] GLOVES

[75] Inventor: Edmund Alan Hough, Wavre, Belgium

[73] Assignee: Imperial Chemical Industries Limited, London, England

[21] Appl. No.: 634,749

[22] Filed: Nov. 24, 1975

[30] Foreign Application Priority Data

Dec. 6, 1974 United Kingdom ..... 52836/74

[51] Int. Cl.[2] ..... A46B 5/04; A47K 7/02

[52] U.S. Cl. ..... 15/227; 15/118; 2/167

[58] Field of Search ..... 15/104.94, 227, 118; 2/158, 161 R, 167; 401/7; 55/382

[56] References Cited

U.S. PATENT DOCUMENTS

| | | | |
|---|---|---|---|
| 1,930,044 | 10/1933 | Farquhar | 15/227 |
| 2,227,707 | 1/1941 | Cooper | 15/227 |
| 3,647,305 | 3/1972 | Baker et al. | 401/7 |
| 3,778,172 | 12/1973 | Myren | 401/7 |

FOREIGN PATENT DOCUMENTS

| | | | |
|---|---|---|---|
| 623,170 | 2/1973 | Belgium | 15/227 |
| 1,000,725 | 10/1951 | France | 15/104.94 |
| 7,002,051 | 8/1971 | Netherlands | 2/167 |
| 448,410 | 12/1967 | Switzerland | 15/227 |
| 1,378,638 | 12/1974 | United Kingdom | 15/209 R |
| 1,378,640 | 12/1974 | United Kingdom | 15/209 R |

*Primary Examiner*—Daniel Blum

*Attorney, Agent, or Firm*—Cushman, Darby & Cushman

[57] ABSTRACT

A disposable waterproof glove comprises an outside layer which is a laminar pile surfaced material with the pile surface outermost and first and second inside water impervious layers of thermoplastic film, the three layers being superimposed and joined together around three edges to form a glove having an open end. The laminar pile surfaced material is formed by feeding a thermoplastic material and a porous backing to a heated surface with the thermoplastic material between the backing and the heated surface so that the thermoplastic softens and bonds to the backing as well as adhering to the heated surface so that the combination of the thermoplastic and peeling the backing away from the heated surface draws the thermoplastic into fibrils or tufts to provide a pile surface on the porous backing.

8 Claims, 3 Drawing Figures

GLOVES

The present invention relates to gloves and in particular waterproof gloves which have a wiping surface and may therefore be used for cleaning in, for example hospitals where the hand of the cleaner may be protected by the waterproof glove.

The present invention therefore provides a waterproof glove which is an envelope of waterproof material carrying a pile surface on at least one of the outer surfaces of the envelope.

The term envelope is used to describe a structure such as a polythene bag sealed on three sides which may be worn over the hand so that the pile surface carried by the bag may be used for cleaning whilst the hand is protected against cleaning fluids and any germs or infections when the glove is used on the hand for cleaning in say hospitals. It should be appreciated however that although the present invention is particularly directed to cleaning materials that may be worn on the hand the principles may be applied in other cleaning outlets.

The waterproof envelope may be of any suitable material and may be manufactured in any suitable way but for the sake of cheapness and ease of manufacture we prefer to use a bag made from thermoplastic films such as polyethylene film. The envelope may be made by sealing together two pieces of film along three sides and then laminating this envelope to a layer of pile surfaced material. Alternatively, the pile surfaced material may itself be laminated to one of the layers of thermoplastic material which forms one of the walls of the envelope. The film (particularly polyethylene) is conveniently lay-flat tubing or such tubing which has been cut at one edge to form lengthwise folded film. The pile surface material preferably formed on a porous e.g. woven or non-woven backing is placed onto, and laminated to, the film by for example heat sealing around the edge of the material. The forming of the envelope and laminating of material thereon may be consecutive but is preferably concurrent.

We find it most convenient to use a pile surfaced material produced from a thermoplastic material according to the techniques of British Patent Specification Nos. 1,378,638, 1,378,639 and 1,378,640. In the techniques of these patents a laminar pile surfaced material is formed by feeding a thermoplastic material and a backing to a heated surface with the thermoplastic material between the backing and the heated surface so that the thermoplastic softens and bonds to the backing as well as adhering to the heated surface so that the combination of the thermoplastic and the backing may be peeled away from the heated surface so that the thermoplastic is drawn into fibrils or tufts to provide a pile surface. In this process the backing material may be a waterproof thermoplastic which can form one of the layers of the envelope or if not the fibrillar thermoplastic may be peeled away from the backing as is described in Belgian Pat. No. 824,953. When these techniques are used the fibrillar layer may be laminated to the other layers of the envelope by any suitable technique including feeding the fibrillar layer as one of the layers in the heat bonding envelope forming process. The pile is preferably fabricated from polyethylene.

The products of the present invention, particularly those in which the fibrillar pile surfaced material is formed by the techniques described above have been found to be particularly useful as hand cleaning materials in hospitals where the products may be worn as a glove and the pile surface may be used as a cleaner for hand wiping actions. The products obtained are comparatively cheap and thus we have found that they are particularly useful as disposable cleaning materials. For example for cleaning shoes in which embodiment it is preferred that the gloves have two pile surfaces most preferably having different properties.

Generally the envelope will be rectangular or square or a tube sealed at one end. The envelope may also be gusseted. In a preferred embodiment the glove is shaped in the form of a mitten having a thumb piece which in use prevents slip of the glove on the hand. If desired the glove may have finger pieces. In a further embodiment, the pile surface is provided on that outer surface which corresponds to the palm of the hand and the open end of the glove is extended to form a sleeve. The invention therefore comprehends a complementary pair of gloves for accommodating left and right hands.

As a wash mitt in hospitals, it has been found that a bag according to the invention was comfortable to use for both patient and nurse, had a pleasant feel and had good lathering and rinsing properties. A particular advantage was in gynaecological and other applications where high wet strength and softness to infected, sore or raw areas is important. In geriatric applications, the mitt was found to have advantage over hitherto available products in being easy to use with one hand and in aiding confidence in patient rehabilitation. In these applications a mitt in the form of a mitten is particularly useful.

The glove of the present invention has the advantage over those made from porous material in that infection and dirt (e.g. faeces) which may be present through use of the use on the pile surface do not come into contact with the hand of the wearer, so alleviating risk of infecting the wearer and so spreading infection.

The invention is illustrated with reference to the accompanying figures of which FIG. 1 is a plan view of a glove of the present invention from the hand palm side;

Figure 1:
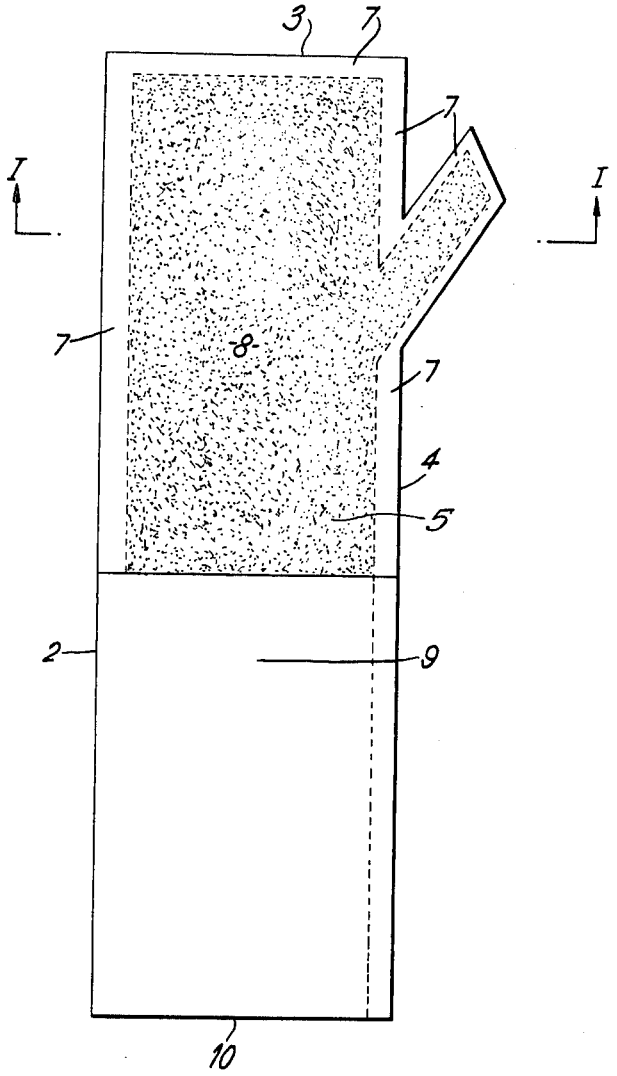
Figure 2:
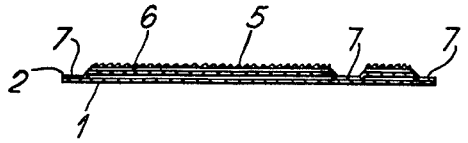
FIG. 2 is a section on the line I—I of FIG. 1.

A piece of low density polyethylene film 1 having a fold about edge 2 is heat sealed about edges 3, 4 to form an envelope having mitten shape illustrated in FIG. 1. A pile surface material comprising a pile 5 of low density polyethylene on a non-woven base layer 6 is laminated to the envelope using heat seals 7 and extends over palm area 8 leaving further area 9 at the open end 10 of the envelope to form a sleeve.

Figure 3:
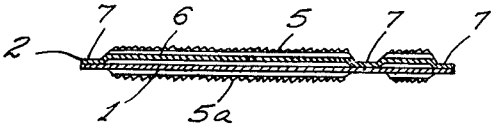
FIG. 3 is a sectional view of a glove having two pile surfaces.

The glove illustrated was made by simultaneously forming heat seal 7 to laminate the pile surface material to the palm side of the future glove and forming heat seals to produce the polyethylene envelope. FIG. 3 illustrates a glove having two pile surfaced layers 5 and 5*a*.

A pile surfaced material for a glove according to the present invention was made as follows:

A laminate comprising low density polyethylene (65 $gm^{-2}$) on non-woven cellulose material (50 $gm^{-2}$) was fed at the rate of 1m per minute against a heated roll (170° C), the polyethylene side of the laminate being in contact with the heated roll. The laminate was held in contact against the heated roll by a rubber pressure roll. The laminate was peeled from the heated roll over a bar (radius 3mm) located 1 mm from the heated roll. The pile surfaced material so formed was cooled and stabilised by air at a temperature of 38.5° C blown against the cellulose side of the material into the pile forming area from apertures in the bar. The flow rate of the air was 550 $Nm^3$.

The resulting material had a short regular hairy polyethylene pile.

I claim:

1. A disposable waterproof glove comprising an outside layer which is a laminar pile surfaced material with the pile surface outermost, first and second inside water impervious layers of thermoplastic film, said three layers being superimposed and joined together completely around only three edges to form a glove having an open end, said laminar pile surfaced material having been formed by feeding a thermoplastic material and a porous backing to a heated surface with the thermoplastic material between the backing and the heated surface so that the thermoplastic softens and bonds to the backing as well as adhering to the heated surface so that the combination of the thermoplastic and peeling the backing away from the heated surface draws the thermoplastic into fibrils or tufts to provide a pile surface on the porous backing, whereby in use a hand inserted into the glove between said first and second inside layers is protected from the material on the pile.

2. A glove as in claim 1 in which said thermoplastic film is polyethylene film.

3. A glove as in claim 1 in which the pile is fabricated from polyethylene.

4. A glove as in claim 1 in which the backing for the laminar pile surfaced material is non-woven material.

5. A glove as in claim 1 in which said three layers are joined together around the three edges by heat seal.

6. A glove as in claim 1 including a second outer layer which is a laminar pile surfaced material with the pile surface outermost.

7. A glove as in claim 6 in which said second outer layer is a laminar pile-surface material having different properties from the first outer layer.

8. A glove as in claim 1 in which laminar pile surfaced material is present on the palm area of the glove, and in which the first and second inside layers extend at the open end of the glove to form a sleeve.

* * * * *